US009581046B2

(12) United States Patent
Hoshi et al.

(10) Patent No.: US 9,581,046 B2
(45) Date of Patent: Feb. 28, 2017

(54) SCROLL STRUCTURE OF CENTRIFUGAL COMPRESSOR

(75) Inventors: Toru Hoshi, Tokyo (JP); Isao Tomita, Tokyo (JP); Motoki Ebisu, Tokyo (JP); Hiroshi Suzuki, Tokyo (JP); Takashi Shiraishi, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 557 days.

(21) Appl. No.: 13/813,172

(22) PCT Filed: Dec. 22, 2011

(86) PCT No.: PCT/JP2011/079793

§ 371 (c)(1), (2), (4) Date: Mar. 8, 2013

(87) PCT Pub. No.: WO2012/090853

PCT Pub. Date: Jul. 5, 2012

(65) Prior Publication Data

US 2013/0272865 A1 Oct. 17, 2013

(30) Foreign Application Priority Data

Dec. 27, 2010 (JP) ..... 2010-291362

(51) Int. Cl.

*F01D 25/24* (2006.01)
*F04D 29/44* (2006.01)
*F04D 29/68* (2006.01)

(52) U.S. Cl.

CPC ..... *F01D 25/24* (2013.01); *F04D 29/441* (2013.01); *F04D 29/681* (2013.01); *F05D 2250/52* (2013.01)

(58) Field of Classification Search

CPC .. F04D 29/441; F04D 29/691; F04D 29/4206; F04D 29/422; F04D 29/4226;

(Continued)

(56) References Cited

U.S. PATENT DOCUMENTS 5,624,229 A * 4/1997 Kotzur ..... F01D 9/026 415/204
6,273,679 B1 * 8/2001 Na ..... F01D 9/026 415/204

(Continued)

FOREIGN PATENT DOCUMENTS

CN 1220375 A 6/1999
DE 3238913 A1 * 4/1984 ..... F04D 29/441

(Continued)

OTHER PUBLICATIONS

Notice of Allowance effective Apr. 9, 2015 issued in the corresponding CN Application No. 201180037782.0 with an English Translation.

(Continued)

*Primary Examiner* — Thomas Denion
*Assistant Examiner* — Jessica Kebea
(74) *Attorney, Agent, or Firm* — Birch, Stewart, Kolasch & Birch, LLP

(57) ABSTRACT

In a scroll structure of a centrifugal compressor, there are provided a radius increase arc portion E in which a radius from the center of a scroll 12 to a scroll centroid P of the cross section of the scroll 12 is gradually increased in any range in a circumferential direction from the start of winding of the scroll, and a radius decrease arc portion F in which the radius is gradually decreased toward a scroll end point Z.

2 Claims, 6 Drawing Sheets

(58) Field of Classification Search
CPC ..... F04D 29/4233; F04D 17/10; F04D 17/16; F04D 17/08; F01D 25/24
USPC ..... 415/204, 206
See application file for complete search history.

(56) References Cited

U.S. PATENT DOCUMENTS

| | | | | |
|---|---|---|---|---|
| 6,439,839 | B1 * | 8/2002 | Song | F04D 29/4226 415/119 |
| 7,186,080 | B2 * | 3/2007 | Smiley, III | F04D 29/4226 415/205 |
| 7,255,533 | B2 * | 8/2007 | Takemoto | F04D 29/441 415/207 |
| 7,334,986 | B2 * | 2/2008 | Sohn | F04D 29/422 415/204 |
| 7,549,842 | B2 * | 6/2009 | Hanson | B60H 1/00471 415/204 |
| 7,972,110 | B2 * | 7/2011 | Seki | F04D 29/4226 415/204 |
| 2008/0267774 | A1 * | 10/2008 | Lian | F04D 29/4226 415/204 |
| 2013/0343885 | A1 * | 12/2013 | Iwakiri | F04D 29/4206 415/204 |

FOREIGN PATENT DOCUMENTS

| | | | | |
|---|---|---|---|---|
| DE | 102009033776 | A1 * | 1/2011 | F04D 29/4226 |
| JP | 60-135695 | A | 7/1985 | |
| JP | 60-135696 | A | 7/1985 | |
| JP | 8-503284 | A | 4/1996 | |
| JP | 2001-263079 | A | 9/2001 | |
| JP | 2005-2951 | A | 1/2005 | |
| JP | 2005-240761 | A | 9/2005 | |
| JP | 2007-211708 | A | 8/2007 | |
| JP | 2007-291877 | A | 11/2007 | |
| JP | 2009-221919 | A | 10/2009 | |
| JP | 2010-209824 | A | 9/2010 | |
| JP | 2010-216378 | A | 9/2010 | |

OTHER PUBLICATIONS

Decision to Grant a Patent effective Feb. 28, 2014 issued in corresponding Japanese Application No. 2010-291362 with an English translation.

Chinese Office Action effective Oct. 28, 2014 issued in the corresponding Chinese Application No. 201180037782.0 with an English Translation.

European Search Report dated Nov. 12, 2014 issued in corresponding European Application No. 11854033.5.

Mishina et al. "Performance Investigations of Large Capacity Centrifugal Compressors" ASME, US, Jan. 1, 1978, pp. 1-11.

International Preliminary Report on Patentability and Written Opinion of the International Searching Authority for International Application No. PCT/JP2011/079793, dated Jul. 11, 2013 with English translation.

* cited by examiner

SCROLL STRUCTURE OF CENTRIFUGAL COMPRESSOR

TECHNICAL FIELD

The present invention relates to a centrifugal compressor having a scroll portion structure which constitutes a flow path spirally formed in an outer peripheral portion of a compressor impeller by rotation of the compressor impeller, and relates to a scroll structure which recovers a static pressure in the scroll portion.

BACKGROUND ART

A centrifugal compressor is required to have high pressure and high efficiency in a wide operation range.

FIG. 5 is an enlarged cross-sectional view of a principal portion of the upper half of the centrifugal compressor above the rotational axis center of a compressor impeller.

A compressor 1 of the centrifugal compressor includes a turbine rotor 2 in which a compressor impeller 3 mainly comprised of a rotary hub 31 and a large number of centrifugal blades 32 attached to the outer peripheral surface of the hub 31 is coupled to a rotation drive source using a shaft, and a compressor housing 11 which accommodates the turbine rotor 2 and forms a flow path of a fluid.

In the compressor housing 11, there are provided a diffuser portion 13 which is formed on the outer peripheral side of the compressor impeller 3 in a substantially toroidal shape and recovers a static pressure by decelerating an air flow discharged from the compressor impeller 3, and a scroll 12 which is formed on the outer peripheral side of the diffuser portion 13 such that the cross-sectional area thereof is spirally increased in a circumferential direction, and decelerates and pressurizes the air flow, and an exit pipe (not shown).

When the compressor impeller 3 rotates, the centrifugal blades 32 compress a fluid such as gas or air introduced from an air passage 15. The flow of the fluid (air flow) formed in this manner passes through the diffuser portion 13 and the scroll 12 from the outer peripheral end of the compressor impeller 3 to be sent to the outside from the exit pipe.

FIG. 6 is a schematic view of the scroll 12 as viewed in plan view.

In FIG. 6, the distribution of a radius R at each of positions set at intervals of 30° from the position at 60° in a clockwise direction with a scroll end point (360° in FIG. 6) used as a 0 reference (0° on a circular coordinate) is constant.

In FIG. 7(A), the horizontal axis indicates a circumferential angle position, while the vertical axis indicates a radius R from a rotational axis center L1 of the compressor of the scroll 12 to a scroll centroid P. FIG. 7(A) shows that the distribution of the radius R is constant.

In addition, FIG. 7(B) is a view in which cross sections of the scroll 12 at individual circumferential positions (set at intervals of 30°) in the clockwise direction relative to the position at 60° in FIG. 6 are stacked and shown, and shows the change of the scroll centroid P in the direction of the radius R.

As a conventional art in which the structure of the scroll is changed, Japanese Patent Application Laid-open No. 2010-209824 (Patent Document 1) is disclosed.

In Patent Document 1, the outer edge of a scroll portion having a flow path spirally formed around the rotational axis of a rotor blade of a turbine which obtains power by supplying fluid gas to the rotor blade includes an arc portion which is formed such that a radius R is constant and a portion in which the radius R is gradually decreased from the end of the arc portion to the end of the scroll portion.

Patent Document 1: Japanese Patent Application Laid-open No. 2010-209824

However, in the technology of Patent Document 1, the scroll structure is for the turbine which obtains power while supplying the fluid gas to the rotor blade to cause expansion, and is different from the scroll structure of the present application which compresses the air flow in the way of flow and nature of the air flow.

In addition, the centrifugal compressor obtains the static pressure by decelerating the flow accelerated by the compressor impeller 3.

In the conventional art as shown in FIG. 7, the deceleration of the air flow is carried out by the diffuser portion 13, and the air flow is not decelerated in the scroll, which results in a loss in the scroll 12 so that it has not been possible to obtain high efficiency and high pressure as the centrifugal compressor.

On the other hand, when the air flow is decelerated in the scroll 12, the thickness of a boundary layer generated between the scroll wall and the fluid is increased so that the static pressure cannot be adequately recovered.

DISCLOSURE OF THE INVENTION

The present invention has been achieved in order to solve the above problems, and an object thereof is to obtain high efficiency and high pressure as the centrifugal pressure by forming portions where the air flow is accelerated and decelerated in the scroll by partially changing the radius from the scroll centroid in the cross section of the scroll to the rotational axis center to allow adequate static pressure recovery.

In order to solve the above problem, a scroll structure of a centrifugal compressor according to the present invention is a scroll structure of a centrifugal compressor forming a flow path of a fluid represented by gas or air discharged from a diffuser portion disposed on a downstream side of a compressor impeller of the centrifugal compressor, wherein there are provided a radius increase arc portion in which a radius from a scroll centroid of each of cross sections which form the scroll and are arranged in a circumferential direction to a rotational axis center of the compressor is gradually increased up to any circumferential angle of the scroll from a start of winding of the scroll, and a radius decrease arc portion in which the radius is gradually decreased toward an end point of the scroll.

With the above configuration, in the portion of the start of winding of the scroll, the thickness of a boundary layer between a scroll wall surface and the fluid is small and the flow resistance of the fluid is small, and hence it is possible to facilitate static pressure recovery by increasing the radius of the scroll to decelerate the fluid, prevent an increase in the thickness of the boundary layer by decreasing the radius up to the portion of the scroll end point from some midpoint to accelerate the fluid, and improve compressor performance by securing the flow rate of the fluid.

In addition, in the present invention, a boundary portion between the radius increase arc portion and the radius decrease arc portion is preferably positioned in a vicinity of 210°, with the end point of the scroll portion being used as a 0 reference (0° on a circular coordinate).

With the above configuration, it is necessary to reduce the velocity of the fluid in order to recover the static pressure and, when the velocity of the fluid is reduced, the boundary layer is generated between the scroll wall and the fluid, the flow resistance is increased, and the loss of the flow rate of the fluid is increased. Consequently, the static pressure is recovered in the range up to 210° by positioning the boundary portion in the vicinity of 210°, the velocity of the fluid is increased to reduce the generation of the boundary layer by forming the radius decrease arc portion in the subsequent range, and it is thereby possible to obtain the compressor performance without losing the static pressure.

Further, in the present invention, an arc relief portion which relieves a change of an arc is preferably provided between the radius increase arc portion and the radius decrease arc portion.

With the above configuration, to cope with abrupt deceleration or acceleration of the fluid, the change of the boundary portion between the radius increase arc portion and the radius decrease arc portion is smoothed, the turbulence of the fluid is suppressed, and an improvement in compressor performance is achieved.

Furthermore, in the present invention, the arc relief portion is preferably formed in a range of substantially 260° to 300°, with the end point of the scroll being used as a 0 reference.

With the above configuration, the static pressure is recovered in the range up to 260°, the change of the boundary portion is smoothed, and the turbulence of the fluid is suppressed by forming the arc relief portion in the range of substantially 260° to 300°, the velocity of the fluid is increased and the generation of the boundary layer is reduced by forming the radius decrease arc portion in the subsequent range, and it is thereby possible to obtain the compressor performance without losing the static pressure.

By providing the radius increase arc portion in which the radius from the rotational axis center of the compressor to the scroll centroid of the cross section of the scroll is gradually increased in any range in the circumferential direction from the diffuser portion and the radius decrease arc portion in which the radius is gradually decreased toward the end point of the scroll portion, the portion in which the air flow is decelerated and the portion in which the air flow is accelerated are formed in the scroll to allow adequate static pressure recovery, and the effect of obtaining high efficiency and high pressure as the centrifugal compressor is thereby achieved.

BEST MODE FOR CARRYING OUT THE INVENTION

Figure 1:
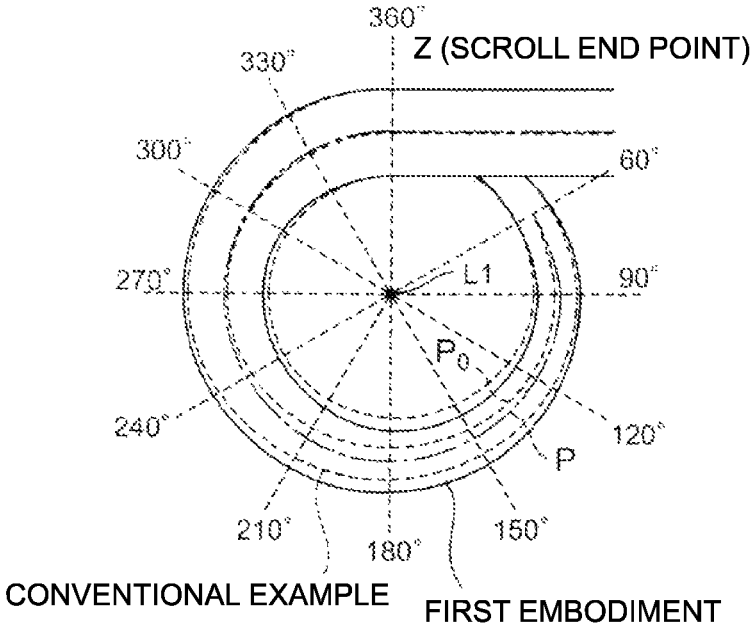
FIG. 1 is a view showing a comparison between a scroll shape according to a first embodiment of the present invention and that of a conventional example.

A detailed description is given hereinbelow of the present invention by using embodiments shown in the drawings.

Note that the scope of the present invention is not limited only to dimensions, materials, shapes, and relative arrangements of constituent parts described in the embodiments unless specifically described, and they are merely illustrative examples.

First Embodiment

Figure 5:
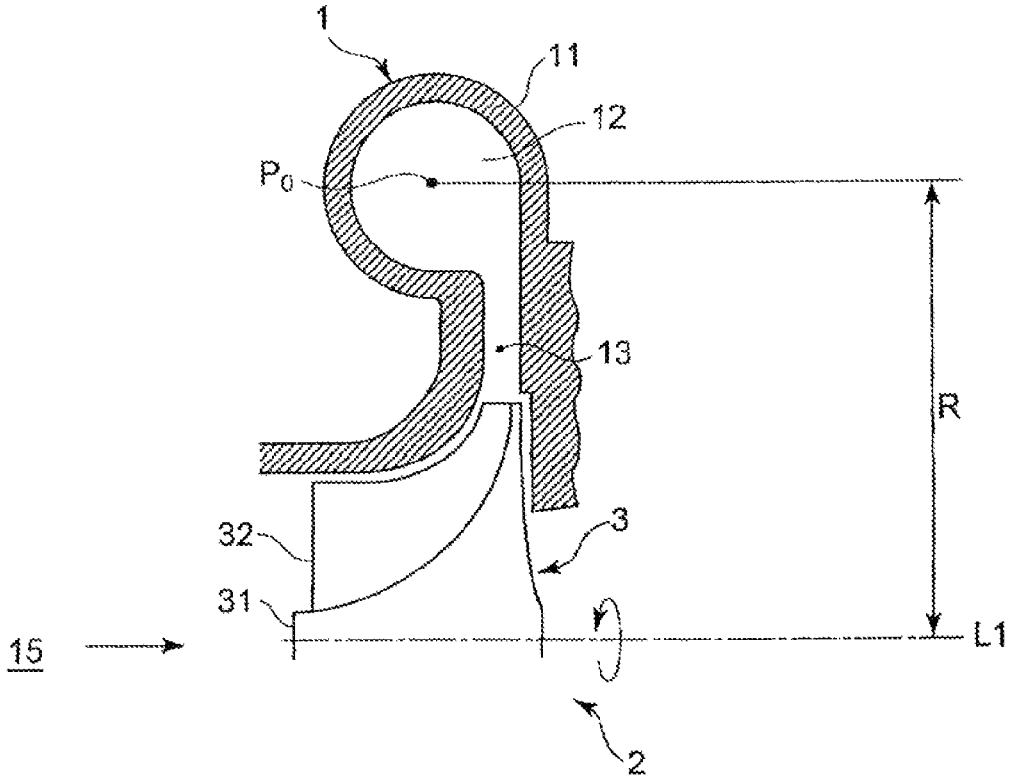
FIG. 5 is an enlarged cross-sectional view of a principal portion of the upper half of a centrifugal compressor of the present invention above the rotational axis center of a compressor impeller.
Figure 6:
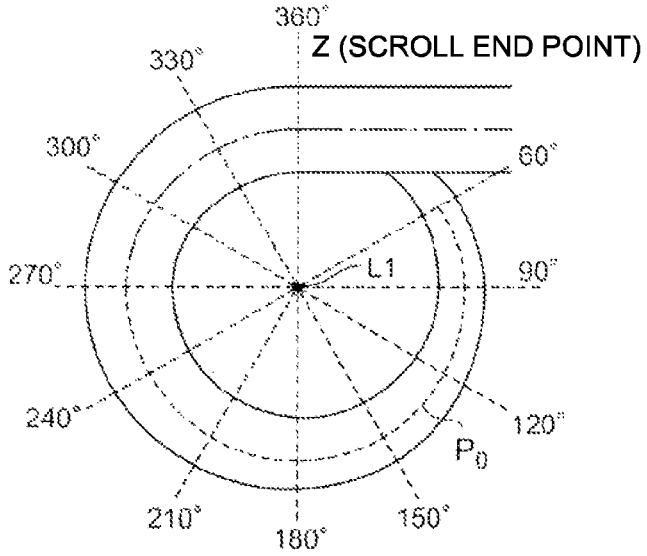
FIG. 6 is a view of a scroll shape in a conventional art.
Figure 7:
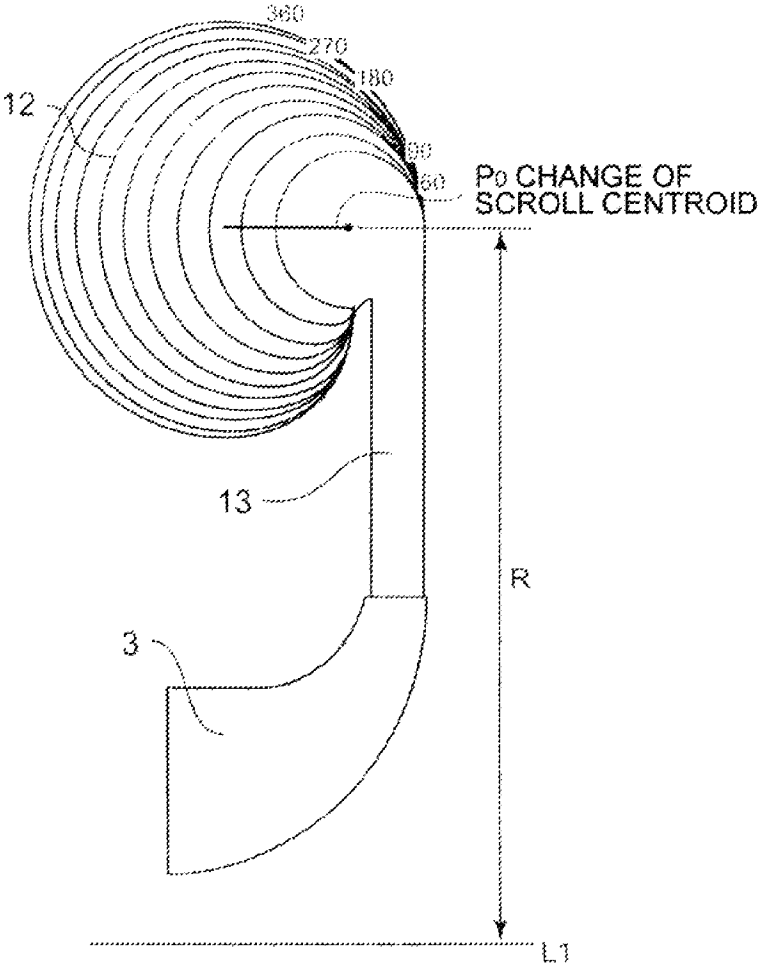
FIG. 7(A) is a view showing a radius at each position in the circumferential direction of the scroll in the conventional art.
FIG. 7(B) is a view in which cross sections at individual positions of the scroll are stacked and shown.
Figure 7:
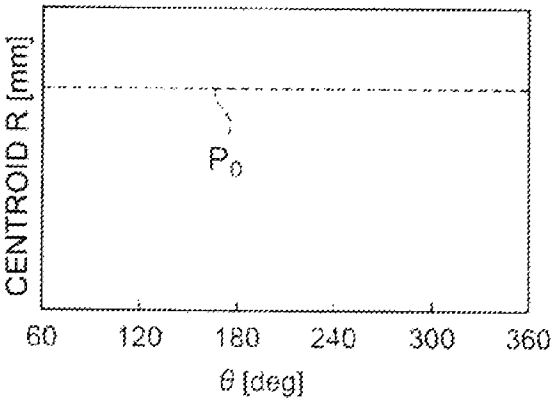

As shown in FIG. 5, in a scroll of the present invention, there are provided, as a flow path of a fluid, a diffuser portion 13 which is formed on the outer peripheral side of a compressor impeller 3 in a substantially toroidal shape and recovers a static pressure by decelerating an air flow discharged from the compressor impeller 3, a scroll 12 which is formed on the outer peripheral side of the diffuser portion 13 such that the cross-sectional area thereof is spirally increased in a circumferential direction, and decelerates and pressurizes the air flow, and an exit pipe (not shown).

When the compressor impeller 3 rotates, a centrifugal blade 32 compresses a fluid such as gas or air introduced from an air passage 15. The flow of the fluid (air flow) formed in this manner passes through the diffuser portion 13 and the scroll 12 from the outer peripheral end of the compressor impeller 3 to be sent to the outside from the exit pipe.

Figure 2:
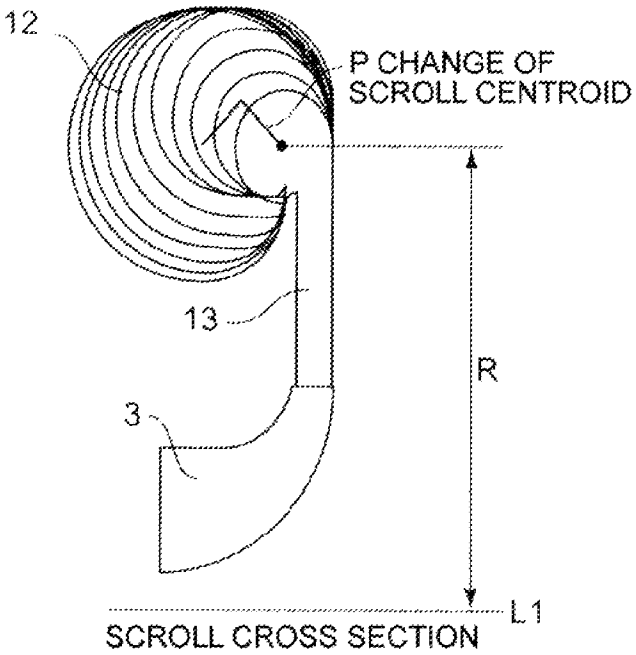
FIG. 2(A) is a view showing a comparison between a radius at each position in a circumferential direction of the scroll in the first embodiment of the present invention and that of the conventional example.
FIG. 2(B) is a view in which cross sections at individual positions of the scroll are stacked and shown.
Figure 2:
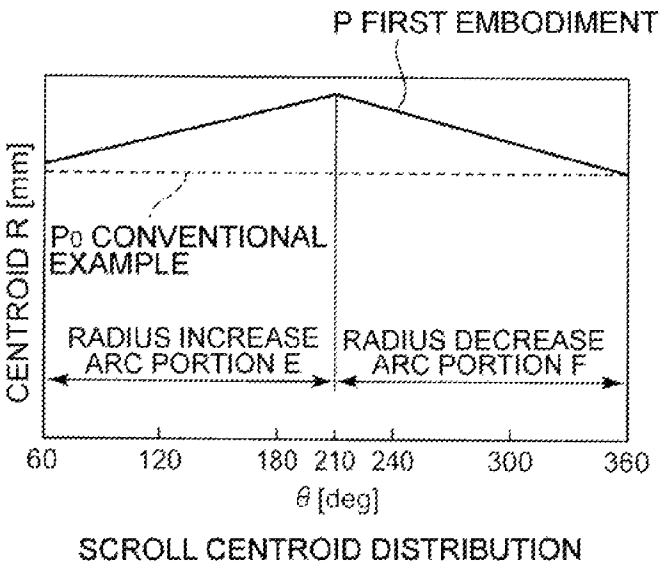

On the basis of FIG. 1 and FIGS. 2(A) and 2(B), a description is given of a scroll structure of a centrifugal compressor according to a first embodiment of the present invention.

FIG. 1 is a view of the scroll 12 as viewed in plan view in which a solid line indicates the shape of the first embodiment and a broken line indicates the shape of a conventional example.

In the scroll structure, the radial cross section of the scroll 12 is substantially circular, and the area of the cross section is gradually increased spirally from the position at 60° to a scroll end point Z in a clockwise direction with the scroll end point Z used as a 0 reference.

In addition, the position at 60° in the clockwise direction in FIG. 1 is a position substantially corresponding to the position at the start of winding of the scroll.

Further, a distance from a rotational axis center L1 of the scroll 12 to a scroll centroid P as the center of each of cross sections at individual positions which form the scroll 12 and are arranged in a circumferential direction, i.e., a radius R is gradually changed.

The way of the change is shown in FIG. 2(A) in which the radius of the scroll centroid P at each of the positions set at intervals of 30° (calibrated in 60° in the drawing) from the position at 60° to the scroll end point Z in the clockwise direction is shown.

A radius increase arc portion E in which the radius of the scroll centroid P is increased is formed from the position at substantially 60° to substantially 210°, and a radius decrease arc portion F in which the radius of the scroll centroid P is decreased is formed from the downstream side of substantially 210° to the scroll end point Z (360°).

Note that the broken line indicates a conventional example in which R is constant, while the solid line indicates the first embodiment.

FIG. 2(B) is a view in which cross sections of the scroll 12 at positions set at intervals of 30° from the position at substantially 60° to the scroll end point Z in the clockwise direction are stacked, and the change of the scroll centroid P can be easily seen from the drawing.

In addition, it is known that the air flow in the scroll 12 satisfies the following relational expression:

$$R \times Cu = \text{constant} \quad (1)$$

R: the radius of the scroll centroid P

Cu: the velocity of the air flow in a circumferential direction (direction of winding of the scroll).

When R (radius) is increased, Cu [the velocity of the air flow in the circumferential direction (direction of winding of the scroll)] is reduced (slow), and the opposite is also true.

Consequently, in the radius increase arc portion in which the radius R of the scroll centroid P is gradually increased from 60° to 210°, the air flow discharged from the diffuser portion 13 is decelerated.

The thickness of a boundary layer generated by an abrasion between the wall surface of the scroll 12 and the fluid (air flow) is small from the position at the start of winding of the scroll 12 (in the vicinity of 60°) to 210°, and hence it is possible to facilitate static pressure recovery by decelerating the air flow.

Thereafter, in the radius decrease arc portion in which the radius R thereof is gradually decreased from the downstream side of 210° to the scroll end point Z, the air flow is accelerated.

When the air flow is accelerated, an increase in the thickness of the boundary layer is prevented so that the velocity of the air flow is secured.

The thickness of the boundary layer is increased along the flow by the deceleration of the air flow, and hence the flow rate of the air flow is reduced.

Accordingly, the deceleration is performed only in a predetermined range (from substantially 60° to 210° in the present embodiment).

The requested performance of the centrifugal compressor is easily allowed by moving the position at 210° from the position at the start of the winding (in the vicinity of 60°) forward or backward according to the selection of high pressure or a nigh air amount.

Note that, when the radius R is increased up to a position far beyond 210°, the static pressure is increased, but the flow rate resistance of the air flow is increased. When the radius R is increased up to a position before 210°, the increase in static pressure is lowered.

The position at 210° is a well-balanced position in the pressure and the air amount for the requested performance of the centrifugal compressor for an engine.

In the portion at the start of winding of the scroll 12, the thickness of the boundary layer between the scroll wall surface and the fluid is small and the flow resistance of the fluid is small, and hence it is possible to facilitate the static pressure recovery by increasing the radius of the scroll to decelerate the fluid, prevent an increase in the thickness of the boundary layer by decreasing the radius up to the portion of the scroll end point from some midpoint to accelerate the fluid, and improve compressor performance by securing the flow rate of the fluid.

It is necessary to reduce the velocity of the fluid in order to recover the static pressure and, when the velocity of the fluid is reduced, the boundary layer is generated between the scroll wall and the fluid, the flow resistance is increased, and the loss of the flow rate of the fluid is increased. Consequently, the static pressure is recovered in the range up to 210° by positioning the boundary in the vicinity of 210°, the velocity of the fluid is increased to reduce the generation of the boundary layer by forming the radius decrease arc portion in the subsequent range, and it is thereby possible to obtain the compressor performance without losing the static pressure.

Second Embodiment

Figure 3:
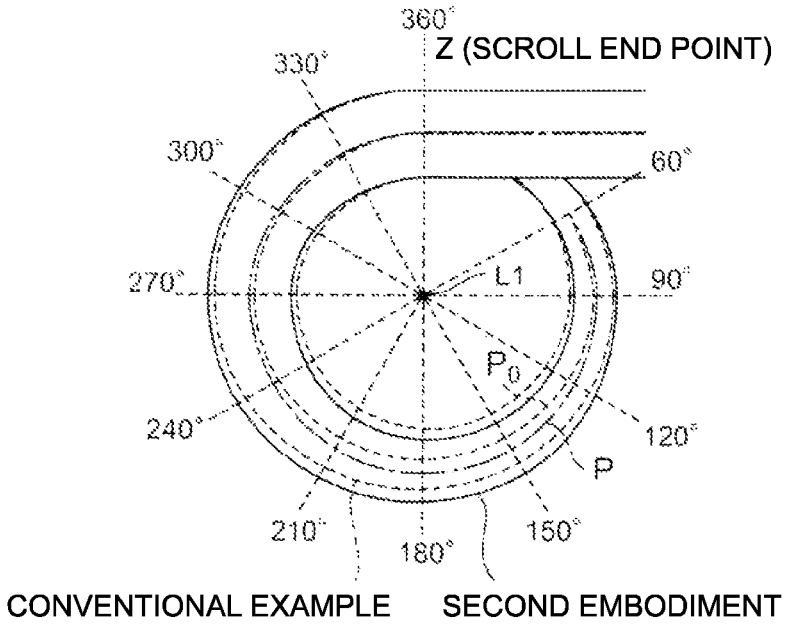
FIG. 3 is a view showing a comparison between a scroll shape according to a second embodiment of the present invention and that of the conventional example.
Figure 4:
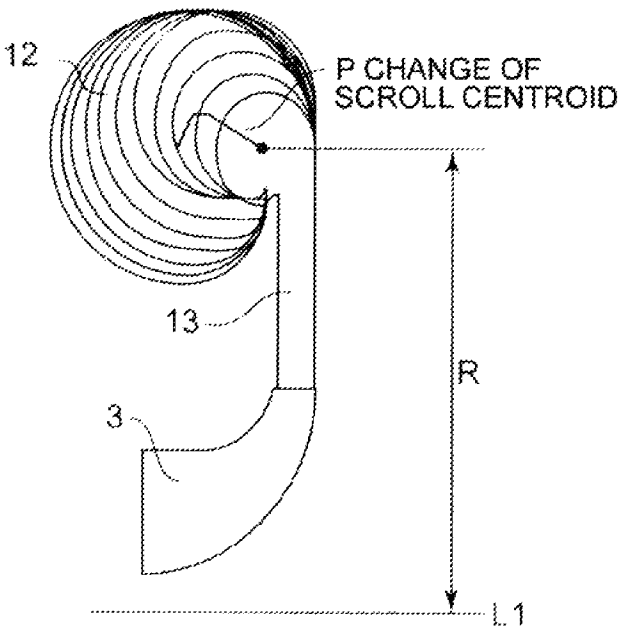
FIG. 4(A) is a view showing a comparison between a radius at each position in the circumferential direction of the scroll in the second embodiment of the present invention and that of the conventional example.
FIG. 4(B) is a view in which cross sections at individual positions of the scroll are stacked and shown.
Figure 4:
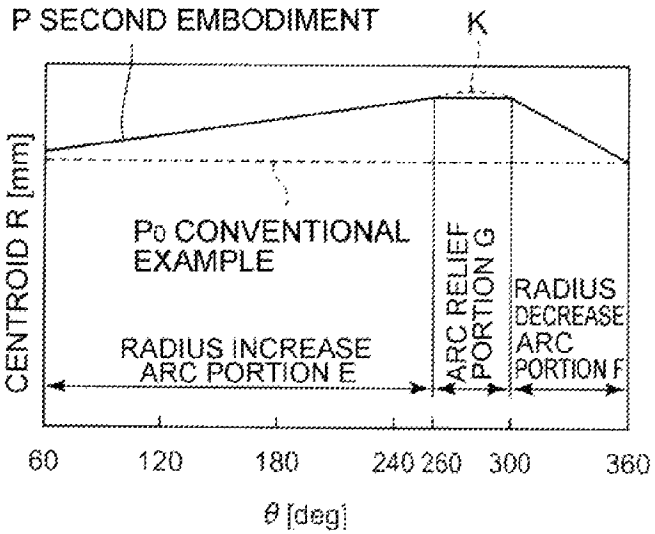

On the basis of FIG. 3 and FIGS. 4(A) and 4(B), a description is given of a scroll structure of a centrifugal compressor according to a second embodiment of the present invention.

Note that the description of the same components as those in the first embodiment is omitted by retaining the same reference numerals.

FIG. 3 is a view of the scroll 12 as viewed in plan view in which the solid line indicates the shape of the second embodiment and the broken line indicates the shape of the conventional example.

In the scroll structure, the radial cross section of the scroll 12 is substantially circular, and the area of the cross section is gradually increased spirally from the position at 60° to 260° in the clockwise direction with the scroll endpoint Z used as the 0 reference to form the radius increase arc portion E of the radius of the scroll centroid P.

In addition, the distance from the rotational axis center L1 of the scroll 12 to the scroll centroid P as the center of each of cross sections at individual positions which form the scroll 12 and are arranged in a circumferential direction, i.e., the radius R is gradually changed (increased).

Further, an arc relief portion G in which the change of the arc is relieved is formed by setting the radius in the range from 260° to 300° to a constant value, and the radius decrease arc portion in which the radius R of the scroll centroid P is decreased is formed from 300° to the scroll end point Z 360°).

The change of the radius R is shown in FIG. 4(A) in which the radius of the scroll centroid P at each of positions set at intervals of 30° (calibrated in 60° in the drawing) from the position at 60° to the scroll end point Z in the clockwise direction is shown.

FIG. 4(B) is a view in which cross sections of the scroll 12 at positions set at intervals of 30° from the position at 60° to the scroll end point Z in the clockwise direction are stacked, and the change of the scroll centroid P can be easily seen from the drawing.

Note that, although the radius of the scroll centroid in the arc relief portion. G is constant in the present embodiment, when an arc shape K (portion indicated by the broken line) is adopted in FIG. 4(A), the turbulence of the air flow can be further suppressed.

By providing the arc relief portion G, the change of the boundary portion between the radius increase arc portion E and the radius decrease arc portion F is smoothed, the turbulence of the air flow is suppressed, and an improvement in compressor performance is achieved.

In addition, the static pressure is recovered in the range up to 260°, the change of the boundary portion is smoothed, and the turbulence of the fluid is suppressed by forming the arc relief portion in the range of 260° to 300°, the velocity of the fluid is increased and the generation of the boundary layer is reduced by forming the radius decrease arc portion in the subsequent range, and it is thereby possible to obtain the compressor performance without losing the static pressure.

INDUSTRIAL APPLICABILITY

The present invention relates to a centrifugal compressor having a scroll portion structure constituting a flow path formed into a spiral shape in an outer peripheral portion of a compressor impeller by rotation of the compressor impeller, and is suitably used in the centrifugal compressor which recovers a static pressure in a scroll portion to obtain high compressor performance.

The invention claimed is:

1. A scroll structure of a centrifugal compressor comprising:

a flow path of a fluid represented by gas or air discharged from a diffuser portion disposed on a downstream side of a compressor impeller of a centrifugal compressor, a scroll having a plurality of cross sections arranged in a circumferential direction to a rotational axis center of the compressor;

a first portion and a second portion of the scroll;

wherein the first portion of the scroll extends from a start winding of the scroll up to a circumferential angle of the scroll that is less than a scroll end point;

the first portion of the scroll being comprised of a first set of the plurality of cross sections of the scroll;

wherein in the first portion of the scroll each successive cross section of the first set of the plurality of cross sections as viewed in a direction of the start winding of the scroll to the circumferential angle has a larger radius than the preceding cross section;

wherein the second portion of the scroll extends continuously from the circumferential angle of the first portion of the scroll to the end point of the scroll;

the second portion of the scroll being comprised of a second set of the plurality of cross sections of the scroll;

wherein in the second portion of the scroll each successive cross section of the second set of the plurality of cross sections as viewed in the direction of the circumferential angle to the end point of the scroll has a smaller radius than the preceding cross section.

2. The scroll structure of a centrifugal compressor according to claim 1, wherein the second portion begins at the circumferential angle, wherein the circumferential angle is 210 degrees°, with the end point of the scroll being used as a 0 reference.

* * * * *